US009073198B1

(12) United States Patent
Menius

(10) Patent No.: US 9,073,198 B1
(45) Date of Patent: Jul. 7, 2015

(54) FLEXIBLE UTILITY HANDLE

(71) Applicant: Marvin L. Menius, Rockwell, NC (US)

(72) Inventor: Marvin L. Menius, Rockwell, NC (US)

( * ) Notice: Subject to any disclaimer, the term of this patent is extended or adjusted under 35 U.S.C. 154(b) by 0 days.

(21) Appl. No.: 14/493,352

(22) Filed: Sep. 23, 2014

(51) Int. Cl.
*B25G 1/04* (2006.01)
*B25G 1/06* (2006.01)

(52) U.S. Cl.
CPC ..... *B25G 1/06* (2013.01)

(58) Field of Classification Search
CPC ..... B25D 17/043; B25G 1/02; B25G 1/04; B25G 1/025; B25G 1/06; B25J 1/02; A61M 25/0144; A61M 25/0136
USPC ..... 16/436, 430, 421, 422, 426, 429, 16/DIG. 41; 294/54.5, 57, 58, 59; 403/220, 403/221, 223, 226, 229; 81/177.1, 177.2, 81/177.8, 177.75, 489; 15/143.1, 144.1, 15/144.2, 144.3, 172
See application file for complete search history.

(56) References Cited

U.S. PATENT DOCUMENTS

| | | | | |
|---|---|---|---|---|
| 634,637 | A | 10/1899 | Allen | |
| 1,013,410 | A * | 1/1912 | Lynch | 403/229 |
| 1,674,983 | A * | 6/1928 | Morton | 403/146 |
| 1,895,229 | A * | 1/1933 | Morton | 403/229 |
| 1,977,180 | A | 10/1934 | Forbes | |
| 2,980,457 | A | 4/1961 | Page | |
| 3,266,059 | A * | 8/1966 | Stelle | 623/62 |
| 3,585,885 | A * | 6/1971 | Carr | 81/57 |
| 4,230,305 | A * | 10/1980 | Comroe | 254/134.3 FT |
| 4,636,109 | A * | 1/1987 | Clausen et al. | 404/10 |
| 4,876,929 | A * | 10/1989 | Kozak | 81/57.43 |
| 5,384,930 | A | 1/1995 | Uno | |
| 5,397,304 | A * | 3/1995 | Truckai | 604/528 |
| 5,455,997 | A * | 10/1995 | Nasiell | 29/456 |
| 5,823,592 | A | 10/1998 | Kalidindi | |
| 5,911,258 | A * | 6/1999 | Morad | 15/145 |
| 6,328,047 | B1 * | 12/2001 | Lee | 135/20.1 |
| 7,100,238 | B2 | 9/2006 | McCauley | |
| 7,270,138 | B2 * | 9/2007 | Liao | 135/82 |
| 7,578,747 | B2 * | 8/2009 | Reilly | 473/219 |
| 7,658,219 | B2 * | 2/2010 | Whittemore | 160/368.1 |
| 2013/0036564 | A1 * | 2/2013 | Tussy | 15/143.1 |

FOREIGN PATENT DOCUMENTS

| | | | |
|---|---|---|---|
| DE | 10004354 | A1 * | 8/2001 |
| EP | 614020 | A1 * | 9/1994 |
| FR | 2969913 | A1 * | 7/2012 |
| GB | 2429946 | A * | 3/2007 |

* cited by examiner

*Primary Examiner* — Chuck Mah

(57) ABSTRACT

A flexible utility handle comprising a handle, an upper tubular section having a female threaded first end and a recessed second end, a lower tubular section having a recessed first end and a male threaded second end, a coiled spring flexibly connecting the upper tubular section and the lower tubular section, and a tension cable operationally connecting the handle and the lower tubular section. The handle includes a cable tension bolt which is operationally designed to engage the female threaded first end of the upper tubular section. Rotating the handle to increase the overall length of the invention decreases its flexibility at the coiled spring. Rotating the handle to decrease the overall length of the invention increases its flexibility at the coiled spring.

17 Claims, 4 Drawing Sheets

FLEXIBLE UTILITY HANDLE

FIELD OF THE INVENTION

The present invention relates to a flexible utility handle which is capable of bending if so desired by its user. The device can accommodate various cleaning and maintenance attachments such as paint rollers, brushes, brooms, and sticky surface rollers for cleaning floors, walls, or such other appropriate surfaces.

BACKGROUND OF THE INVENTION

Handles for various utility purposes are common items and are readily available at hardware stores and such other suppliers of these goods. Often these handles are designed and manufactured for a single purpose which in turn results in a consumer having numerous such utility handles to address common maintenance duties. These single purpose utility handles are typically manufactured and mounted with a single purpose utility device on its functional end. Examples of such single purpose utility handles and devices include mops, brooms of various types, brushes, and paint rollers.

A limitation of many utility handles is demonstrated by the handle's inability to bend to accommodate the user's need to angle the use of the device and then have the handle return to a rigid configuration when a user finds it necessary to exert more than a minimum force to complete a particular task.

Accordingly, there remains room for improvement and variation within the art.

SUMMARY OF THE INVENTION

It is at least one of the present embodiments to provide a utility handle comprising an upper tubular section, a lower tubular section, a handle, a coiled spring, and a tension cable. The upper tubular section includes a female threaded first end and a recessed second end. The lower tubular section includes a recessed first end and a male threaded second end. The handle of the present invention is operationally designed to rotatably engage the female threaded first end of the upper tubular section. The coiled spring flexibly connects the upper tubular section and the lower tubular section. Additionally, the tension cable, having a first end and a second end, operationally connects the handle of the present invention to its lower tubular section and is of a length sufficient to permit the coiled spring to flex and bend at a 90 degree angle.

It is at least one aspect of the present embodiments to provide a cable centering washer for the recessed second end of the upper tubular section, wherein the cable centering washer includes a central aperture to receive and permit the passage of the tension cable.

It is still a further aspect of at least one of the present embodiments to provide a cable anchor washer within the recessed first end of the lower tubular section, the cable anchor washer having a central aperture to engage the anchor means of the tension cable.

It is a further aspect of at least one of the present embodiments to provide a male threaded second end for the lower tubular section that is operationally designed to detachably attach one of a plurality of individual cleaning devices with a female threaded attaching means.

It is at least one aspect of the present embodiments to provide a handle comprising a first end with horizontal aperture and a recessed second end configured to receive a cable tension bolt comprising a flat circular head, a threaded male end, and a central channel, wherein the flat circular head being configured to be received inside the recessed second end of the handle and includes a radial aperture designed to engage an allen set screw that is operationally configured to engage and secure the first end of the tension cable, wherein the threaded male end is operationally designed to engage the female threaded first end of the upper tubular section, and wherein the central channel longitudinally traverses the cable tension bolt and is designed to receive the first end of the tension cable.

It is a further aspect of at least one of the present embodiments to provide a coiled spring comprising a first end that is operationally configured to engage a cable centering washer and a second end that is operationally configured to engage a cable anchor washer, and having an inner rubber core with a central channel to receive and permit the passage of the tension cable, wherein the central channel longitudinally traverses the inner rubber core.

It is at least one aspect of the present embodiments to provide an anchor means that is operationally configured to engage the central aperture of the cable anchor washer to secure the second end of the tension cable.

It is a further aspect of at least one of the present embodiments to provide a gripping means on the upper tubular section of the present invention.

It is still a further aspect of at least one of the present embodiments to provide for a method of using a flexible utility handle comprising the steps of providing a flexible utility handle comprising an upper tubular section having a female threaded first end and a recessed second end, wherein the recessed second end includes a cable centering washer, the cable centering washer having a central aperture to receive and permit the passage of a tension cable; a lower tubular section having a recessed first end and a male threaded second end, wherein the recessed first end includes a cable anchor washer with a central aperture to engage the anchor means of the tension cable, wherein the male threaded second end of the lower tubular section being operationally designed to detachably attach one of a plurality of cleaning devices having a female threaded attaching means; a handle that is operationally designed to rotatably engage the female threaded first end of the upper tubular section, wherein the handle includes a first end and a recessed second end, wherein the first end having a horizontal aperture, and wherein the recessed second end being configured to receive a cable tension bolt, the cable tension bolt comprising a flat circular head configured to be received inside the recessed second end of the handle, wherein the flat circular head includes a radial aperture designed to engage an allen set screw that is configured to engage and secure the first end of the tension cable, a threaded male end operationally designed to engage the female threaded first end of the upper tubular section, and a central channel longitudinally traversing the cable tension bolt that is designed to receive the first end of the tension cable; a coiled spring flexibly connecting the upper tubular section and the lower tubular section, wherein said coiled spring comprising an inner rubber core having a central channel longitudinally traversing said inner rubber core to receive and permit the passage of said tension cable, wherein said coiled spring further comprising a first end operationally configured to engage said cable centering washer, and a second end operationally configured to engage said cable anchor washer; and a tension cable operationally connecting the handle and the lower tubular section, the tension cable having a first end and a second end, wherein the second end includes an anchor means being operationally configured to engage the central aperture of the cable anchor washer to secure the second end of the tension cable; attaching a female threaded cleaning device to the male threaded second end of the lower tubular section; rotating the handle so that the cable tension bolt advances into the female threaded first end of the upper tubular section to provide flexibility to the coiled spring by decreasing the overall length of the flexible utility handle to reduce the tension on the tension cable; and rotating the handle so that the cable tension bolt advances out of the female threaded first end of the upper tubular section to provide rigidity to the coiled spring by increasing the overall length of the flexible utility handle to increase the tension on the tension cable.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
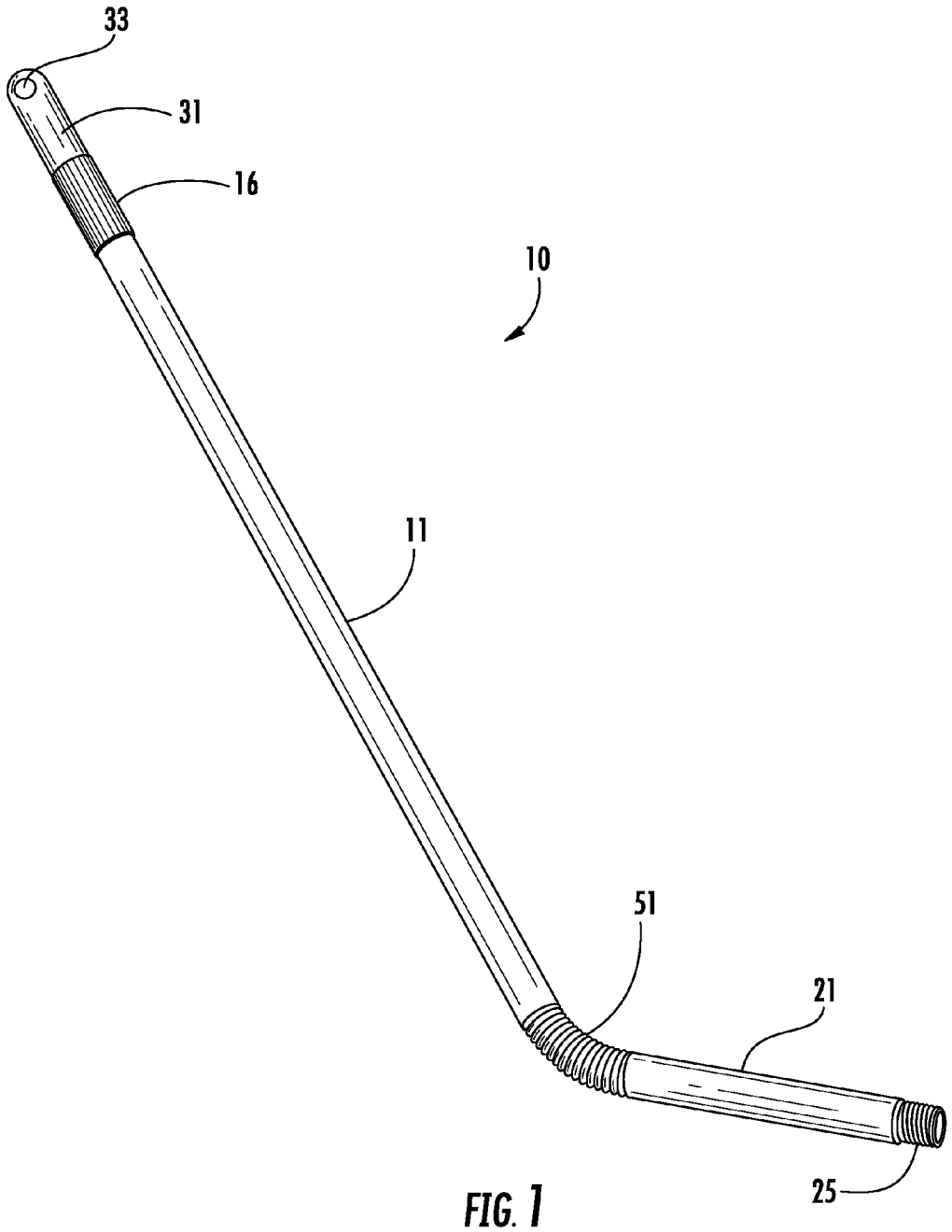
FIG. 1 is a perspective view of a flexible utility handle.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention. Which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

As seen in reference to FIGS. 1 to 6, a flexible utility handle 10 is provided. In accordance with the present invention, a flexible utility handle 10 comprising an upper tubular section 11 with a female threaded first end 12 and a recessed second end 13, a lower tubular section 21 with a recessed first end 22 and a male threaded second end 25, a handle 31 that is rotationally associated with the female threaded first end 12 of the upper tubular section 11, a coiled spring 51 that is operationally associated with the recessed second end 13 of the upper tubular section 11 and operationally associated with the recessed first end 22 of the lower tubular section 21, and a tension cable 61 that is operationally associated and secured at its first end 62 to the handle 31 and traveling within the upper tubular section 11, within the coiled spring 51, and within the lower tubular section 21, and being operationally associated and secured at the recessed first end 22 of the lower tubular section.

Figure 2:
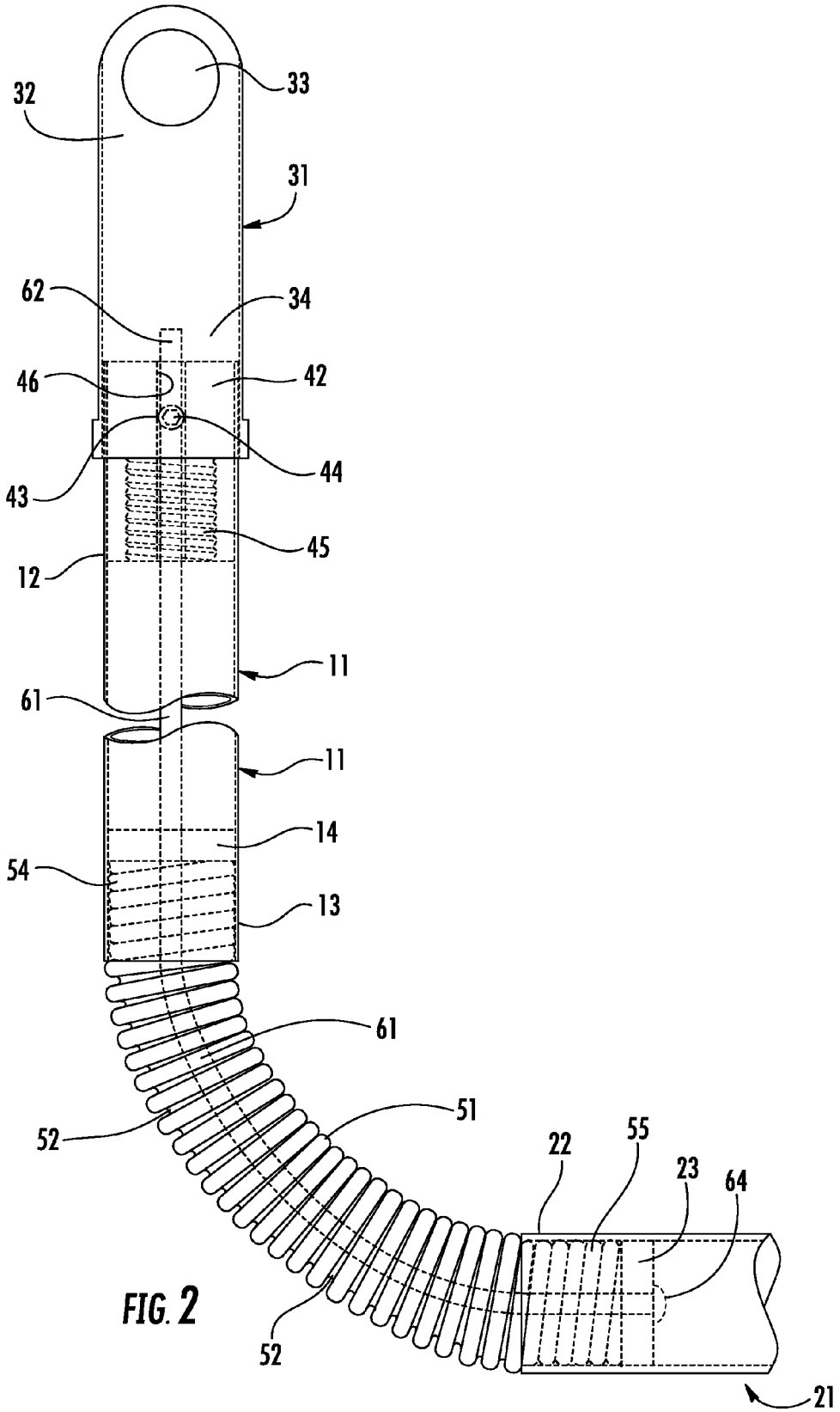
FIG. 2 is a close-up perspective view of a flexible utility handle.
Figure 3A:
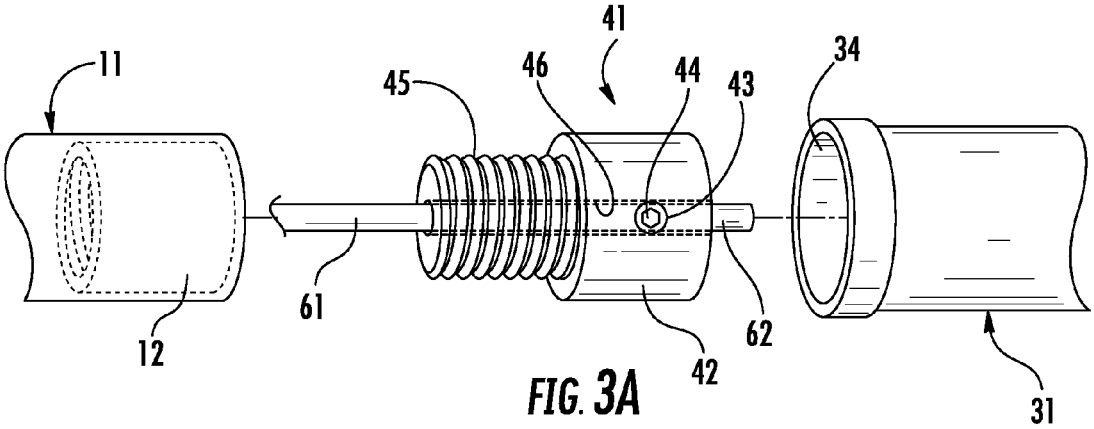
FIG. 3A is an exploded view illustrating a cable tension bolt relative to an upper tubular section and a handle of the present invention.
Figure 3B:
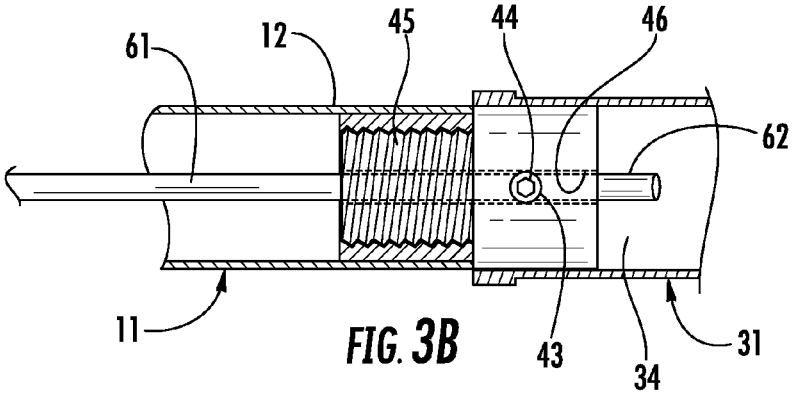
FIG. 3B is a cross sectional view of a cable tension bolt engaging an upper tubular section to increase flexibility for the present invention.
Figure 3C:
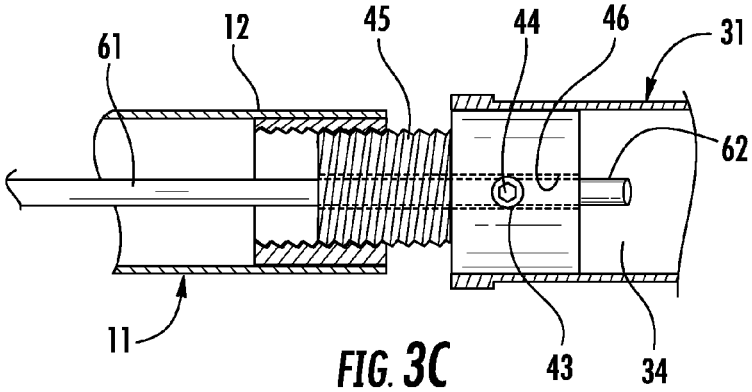
FIG. 3C is a cross sectional view of a cable tension bolt engaging an upper tubular section to decrease flexibility for the present invention.
Figure 4:
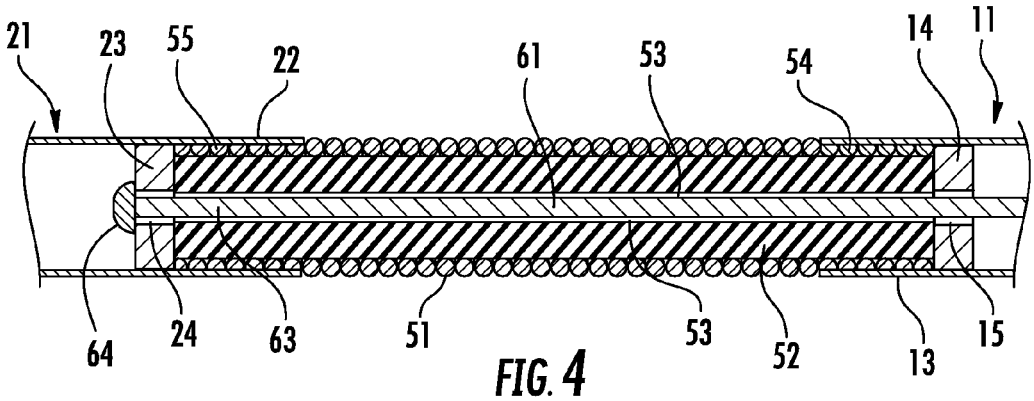
FIG. 4 is a cross sectional view of a coiled spring relative to a lower tubular section and an upper tubular section of the present invention.
Figure 5A:
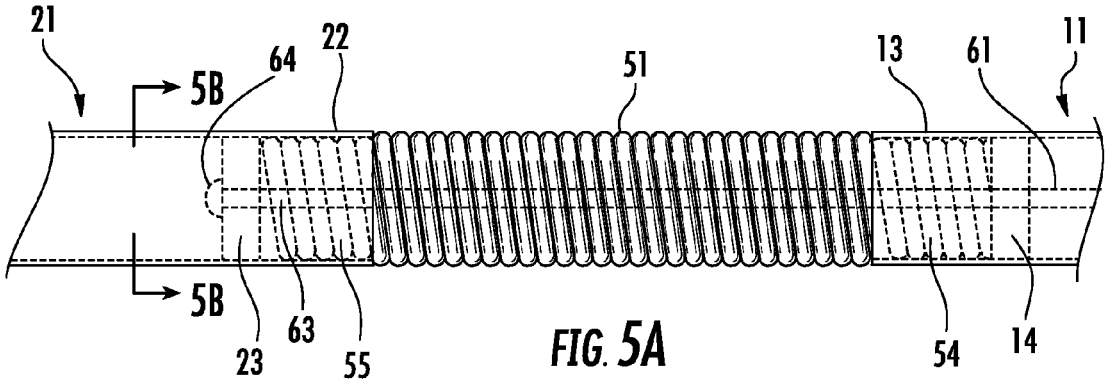
FIG. 5A is perspective view of a coiled spring relative to a lower tubular section and an upper tubular section of the present invention.
Figure 5B:
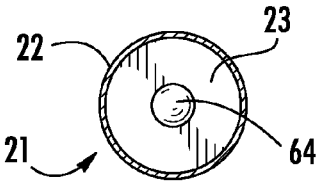
FIG. 5B is a cross sectional view illustrating a cable anchor washer engaging an anchor means.

Now referring to the FIGS. 1 and 2 the present invention includes a handle 31 that is operationally designed to rotatably engage a female threaded first end 12 of the upper tubular section 11. The handle includes a first end 32 and a recessed second end 34. A horizontal aperture 33 is located at the first end 32 of the handle as a convenience attribute to permit the present invention to be hanged during storage. The recessed second end 34 of the handle is configured to receive a cable tension bolt 41. In a preferred embodiment of the present invention the handle is constructed of a lightweight plastic material with sufficient rigidity and strength to endure the rotational interaction between the threaded male end 45 of cable tension bolt 41 located in the handle 31 and the female threaded first end 12 of the upper tubular section 11. In other embodiments the handle may be constructed from wood or metal materials.

Referring to FIGS. 2, 3A, 3B, and 3C, a cable tension bolt 41 is illustrated for one embodiment of the present invention comprising a flat circular head 42 configured to be received and secured in a stationary position inside the recessed second end 34 of the handle 31. The flat circular head 42 includes a radial aperture 43 that is designed to engage an allen set screw 44, the allen set screw being operationally configured to engage and secure the first end 62 of the tension cable 61, The cable tension bolt also includes a threaded male end 45 that is operationally designed to engage the female threaded first end 12 of the upper tubular section 11. Additionally, a central channel 46 longitudinally traverses the cable tension bolt. The central channel is designed to receive the first end 62 of the tension cable 61. Construction materials for the cable tension bolt in a preferred embodiment can be any metal or plastic of sufficient rigidity and strength.

The upper tubular section 11 of the present invention is generally shown in FIGS. 1 to 4. Now referring specifically to FIGS. 2, 3A, 3B, and 3C, the upper tubular section 11 includes a female threaded first end 12 that is operationally designed to engage the threaded male end 45 of the cable tension bolt 41. Now referring specifically to FIGS. 2, 4, and 5, the upper tubular section 11 of the present invention also includes a recessed second end 13. The recessed second end 13 of the upper tubular section 11 comprising a cable centering washer 14 being secured in a fixed position within the recessed second end. The cable centering washer 14 includes a central aperture 15 to receive and permit the passage of said tension cable 61 when the cable tension bolt engages the female threaded first end 12 of the upper tubular section 11 of the present invention.

The coiled spring 51 flexibly connecting the upper tubular section 11 to the lower tubular section 21 of the present invention is illustrated generally in FIG. 1. Now referring to FIGS. 2, 4, and 5A, the coiled spring 51 has a first end 54 that is operationally configured to engage the cable centering washer 14 of the recessed second end 13 of the upper tubular section 11. The coiled spring 51 also has a second end 55 operationally configured to engage the cable anchor washer 23 located within the recessed first end 22 of the lower tubular section 21 of the present invention. In the preferred embodiment of the present invention the coiled spring is manufactured from steel. However, other embodiments of the present invention may include a coiled spring manufactured from other materials so long as such other materials have the required combination of rigidity and elasticity to meet the needs of the present invention. In order to provide a smooth surface transition between the upper tubular section 11 and the first end 54 of the coiled spring 51 and a smooth transition between the lower tubular section 21 and the second end 55 of the coiled spring 51, the outside diameter of both the first and second ends 54, 55 of the coiled spring are machined down to compliment the inside diameter of the upper and lower tubular sections 11, 21 as necessary to permit the first end 54 of the coiled spring to engage the cable centering washer 14 of the upper tubular section 11 and the second end 55 of the coiled spring to engage the cable anchor washer 23 of the lower tubular section 21. Now referring to FIG. 4, in a preferred embodiment of the present invention the coiled spring 51 includes an inner rubber core 52 with a central channel 53 longitudinally traversing its length. The central channel 53 of the rubber core 52 receives and permits said the passage of the tension cable 61 within the rubber core. In addition to providing a more defined passage of the tension cable through the coiled spring, the rubber core also serves to stabilize the coiled spring when in its flexed or rigid configuration.

Figure 6:
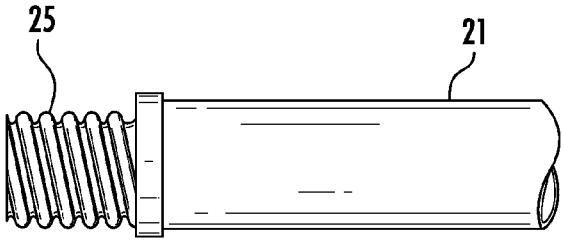
FIG. 6 is a perspective view of a male threaded second end of the lower tubular section of the present invention.

Now referring to FIGS. 1, 2, and 6, the lower tubular section 21 of the present invention is illustrated, wherein the lower tubular section includes a recessed first end 22 and a male threaded second end 25. Referring to FIGS. 2, 4, 5A, and 5B, the recessed first end 22 of the lower tubular section 21 comprising a cable anchor washer 23 with a central aperture 24 to engage the anchor means 64 of the tension cable 61, The cable anchor washer 33 being positioned and secured into a fixed position within the recessed first end 22 of the lower tubular section 21. Although in the preferred embodiment of the present invention the upper and lower tubular sections 11, 21 are constructed of light-weight aluminum metal, it is to be expected that other materials capable of providing sufficient rigidity and strength may also be used to manufacture the upper and lower tubular sections of the present invention such as plastic, wood, or steel. Referring to FIGS. 1 and 6, the male threaded second end 25 of the lower tubular section 21 being operationally designed to detachably attach individual cleaning devices having a complimentary female threaded attaching means.

Referring to FIGS. 2 to 5B, the present invention includes a tension cable 61, having first and second ends 62, 63 that is operationally associated and secured at the first end 32 of the handle 31 and traveling within the upper tubular section 11, within the coiled spring 51, and within the lower tubular section 21, and being operationally associated and secured at the recessed first end 22 of the lower tubular section 21. The first end 62 of the tension cable 61 travels through the threaded male end 45 of the cable tension bolt 41, then through the flat circular head 42 of the cable tension bolt. The allen set screw 44 is turned to engage the tension cable 61 and to secure the first end 62 in a fixed position. The second end 63 of the tension cable 61 comprising an anchor means 64 to engage the cable anchor washer 23 to secure the second end 63 of the tension cable 61 in a fixed position within the recessed first end 22 of the lower tubular section 21. In a preferred embodiment of the present invention the anchor means 64 includes a solution of bronze melted into the tension cable second end 63 therein preventing the tension cable 61 from pulling through the central aperture 24 of the cable anchor washer 23.

In an embodiment of the present invention spot welds are placed around the cable centering washer 14 to secure it within the recessed second end 13 of the upper tubular section 11. Also, spot welds are placed around the cable anchor washer 24 to secure it within the recessed first end 22 of the lower tubular section 21. In similar fashion spot welds are also used to secure the first and second ends 54, 55 of the spring coil 51 within the recessed second end 13 of the upper tubular section 11 and the recessed first end 22 of the lower tubular section 21 respectively.

In still another embodiment of the present invention the upper tubular section 11 includes a gripping means 16 which is affixed to and encircles the outside of the female threaded first end 12 of the upper tubular section 11. The gripping means 16 may include grooves etched into the surface of the upper tubular section or thin corrugated plastic cemented to the surface of the upper tubular section.

The present invention also includes a method of using a flexible utility handle 10 depicted in FIGS. 1 to 6 comprising the steps of: providing a flexible utility handle 10 comprising an upper tubular section 11 having a female threaded first end 12 and a recessed second end 13, wherein the recessed second end includes a cable centering washer 14 having a central aperture 15 to receive and permit the passage of a tension cable 61; a lower tubular section 21 having a recessed first end 22 and a male threaded second end 25, wherein the recessed first end includes a cable anchor washer 23 having a central aperture 24 to engage an anchor means 64 for the tension cable 61; a handle 31 operationally designed to rotatably engage the female threaded first end 12 of the upper tubular section 11, the handle comprising a first end 32 and a recessed second end 34 that is configured to receive a cable tension bolt 41, wherein the cable tension bolt having a threaded male end 45 operationally designed to engage the female threaded first end 12 of the upper tubular section 11; and a central channel 46 longitudinally traversing the tension bolt 41, the channel being designed to receive the first end 62 of the tension cable 61; a coiled spring 51 flexibly connecting the upper tubular section 11 and the lower tubular section 21, wherein said coiled spring comprising an inner rubber core 52 having a central channel 53 longitudinally traversing said inner rubber core to receive and permit the passage of said tension cable 61, wherein said coiled spring further comprising a first end 54 operationally configured to engage said cable centering washer 14, and a second end 55 operationally configured to engage said cable anchor washer 23; and a tension cable 61 operationally connecting the handle 31 and the lower tubular section 21, said tension cable having a first end 62 and a second end 63, wherein said second end includes an anchor means 64 being operationally configured to engage the central aperture 24 of said cable anchor washer 23 to secure the second end 63 of the tension cable 61; attaching a female threaded cleaning device to the male threaded second end 25 of the lower tubular section 21; rotating the handle 31 so that the cable tension bolt 41 advances into the female threaded first end 12 of the upper tubular section 11 to provide flexibility to the coiled spring 51 by decreasing the overall length of the flexible utility handle to reduce the tension on the tension cable; and rotating the handle 31 so that the cable tension bolt 41 advances out of the female threaded first end 12 of the upper tubular section 11 to provide rigidity to the coiled spring Si by increasing the overall length of the flexible utility handle to increase the tension on the tension cable.

Referring to the method described above, in one embodiment, the male threaded second end 25 of the lower tubular section 21 is operationally designed to detachably attach a variety of cleaning devices having a female threaded attaching means including mops, brooms of various types, brushes, and paint rollers.

In one embodiment of the above method, the handle 41 comprising a first end 32 having a horizontal aperture 33.

In another embodiment of the above method, the cable tension bolt 41 includes a flat circular head 42 configured to be received inside the recessed second end 34 of the handle 31, a threaded male end 45 operationally designed to engage the female threaded first end 12 of the upper tubular section 11; and a central channel 46 longitudinally traversing the tension bolt 41, the channel being designed to receive the first end 62 of the tension cable 61. Additionally, the flat circular head 42 of the cable tension bolt 41 comprises a radial aperture 43 designed to engage an allen set screw 44 which is operationally configured to engage and secure the first end 62 of the tension cable 61.

Although preferred embodiments of the invention have been described using specific terms, devices, and methods, such description if for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained herein, That which is claimed:

1. A flexible utility handle comprising:

an upper tubular section having a female threaded first end and a recessed second end;

a lower tubular section having a recessed first end and a male threaded second end;

a handle operationally designed to rotatably engage the female threaded first end of the upper tubular section;

a coiled spring having a first end and a second end, the coiled spring flexibly connecting the recessed second end of the upper tubular section and the recessed first end of the lower tubular section; and a tension cable with a first end and a second end, said tension cable is operationally associated and secured at its first end to the handle, traveling within the upper tubular section, within the coiled spring, and within the lower tubular section, and secured at its second end with an anchor means to the lower tubular section wherein the tension cable selectively provides an axial force to compress the coiled spring axially between the upper and lower tubular sections.

2. The flexible utility handle of claim 1, wherein said recessed second end of the upper tubular section comprising a cable centering washer operationally configured to engage the first end of said coiled spring, said cable centering washer having a central aperture to receive and permit the passage of said tension cable.

3. The flexible utility handle of claim 1, wherein said recessed first end of the lower tubular section comprising a cable anchor washer operationally configured to engage the second end of said coiled spring, said cable anchor washer having a central aperture to engage said anchor means of the tension cable.

4. The flexible utility handle of claim 3, wherein said central aperture of said cable anchor washer being operationally configured to engage the anchor means to secure the second end of the tension cable within the lower tubular section.

5. The flexible handle of claim 1, wherein said male threaded second end of the lower tubular section being operationally designed to detachably attach one of a plurality of individual cleaning devices having a female threaded attaching means.

6. The flexible utility handle of claim 1, wherein said handle comprising a first end and a recessed second end, wherein said first end having a horizontal aperture, and wherein said recessed second end being configured to receive and secure a cable tension bolt within the recessed second end so that said cable tension bolt turns rotationally with said handle to engage the female threaded first end of the upper tubular section, whereby a rotation of said handle in one direction decreases said axial force and rotation of said handle in an opposite direction increases said axial force.

7. The flexible utility handle of claim 6, wherein said cable tension bolt comprising:

a flat circular head configured to be received and secured inside the recessed second end of the handle, said flat circular head includes a threaded radial aperture housing an allen set screw;

a threaded male end operationally designed to engage the female threaded first end of the upper tubular section; and a central channel longitudinally traversing said cable tension bolt, said channel being designed to receive the first end of the tension cable.

8. The flexible utility handle of claim 7, wherein said allen set screw being operationally configured to engage and secure the first end of the tension cable.

9. The flexible utility handle of claim 1, wherein said coiled spring comprising an inner rubber core extending there through, said inner rubber core having a central channel longitudinally traversing said inner rubber core to receive and permit the passage of said tension cable.

10. The flexible utility handle of claim 1, wherein said first end of the upper tubular section includes a gripping means.

11. The flexible utility handle of claim 1, wherein the tension cable comprising a length sufficient to permit the coiled spring to bend.

12. The method of using a flexible utility handle comprising the steps of:

providing a flexible utility handle comprising:

an upper tubular section having a female threaded first end and a recessed second end;

a lower tubular section having a recessed first end and a male threaded second end;

a handle operationally designed to rotatably engage the female threaded first end of the upper tubular section;

a coiled spring having a first end and a second end, the coiled spring flexibly connecting the recessed second end of the upper tubular section and the recessed first end of the lower tubular section; and a tension cable with a first and a second end, said tension cable is operationally associated and secured at is first end to the handle, traveling within the upper tubular section, within the coiled spring, and within the lower tubular section, and secured at its second end with an anchor means to the lower tubular section wherein the tension cable selectively provides an axial force to compress the coiled spring axially between the upper and lower tubular sections;

attaching a female threaded cleaning device to the male threaded second end of the lower tubular section;

rotating the handle so that the cable tension bolt advances into the female threaded first end of the upper tubular section to provide flexibility to the coiled spring by decreasing the length of the flexible utility handle to reduce the axial force on the tension cable; and rotating the handle so that the cable tension bolt advances out of the female threaded first end of the upper tubular section to provide rigidity to the coiled spring by increasing the length of the flexible utility handle to increase the axial force on the tension cable.

13. The method of claim 12, wherein said recessed second end of the upper tubular section comprising a cable centering washer operationally configured to engage the first end of said coiled spring, said cable centering washer having a central aperture to receive and permit the passage of said tension cable.

14. The method of claim 12, wherein said recessed first end of the lower tubular section comprising a cable anchor washer operationally configured to engage the second end of said coiled spring, said cable anchor washer having a central aperture to engage said anchor means of the tension cable to secure the second end of the tension cable within the lower tubular section.

15. The method of claim 12, wherein said handle comprising a first end and a recessed second end, wherein said first end having a horizontal aperture, and wherein said recessed second end being configured to receive and secure a cable tension bolt within the recessed second end so that said cable tension bolt turns rotationally with said handle to engage the female threaded first end of the upper tubular section, wherein said cable tension bolt comprising a flat circular head configured to be received and secured inside the recessed second end of the handle, said flat circular head includes a threaded radial aperture housing an allen set screw, said allen set screw being operationally configured to engage and secure the first end of the tension cable;

a threaded male end operationally designed to engage the female threaded first end of the upper tubular section; and a central channel longitudinally traversing said cable tension bolt, said channel being designed to receive the first end of the tension cable.

16. The method of claim 12, wherein said coiled spring comprising an inner rubber core extending there through, said inner rubber core having a central channel longitudinally traversing said inner rubber core to receive and permit the passage of said tension cable.

17. The method of claim 12, wherein the tension cable comprising a length sufficient to permit the coiled spring to bend.

* * * * *